US005775611A

United States Patent [19]

Threlkeld

[11] Patent Number: 5,775,611

[45] Date of Patent: Jul. 7, 1998

[54] SUPPORT FOR A TRAVELING STRAND OF RUBBER YARN

[76] Inventor: James O. Threlkeld, 4100 Barringer Dr., Charlotte, N.C. 28217

[21] Appl. No.: 614,694

[22] Filed: Mar. 13, 1996

[51] Int. Cl.[6] ..... B65H 57/00; B65H 20/00; B65H 23/32

[52] U.S. Cl. ..... 242/157 R; 226/97; 226/199

[58] Field of Search ..... 242/157 R, 615.4, 242/47 R, 36; 226/89, 97, 118, 119, 199, 196

[56] References Cited

U.S. PATENT DOCUMENTS

| | | | |
|---|---|---|---|
| 3,216,638 | 11/1965 | Brickle et al. | 226/97 |
| 3,763,483 | 10/1973 | Urmenyi | 340/259 |
| 4,015,314 | 4/1977 | Hurst et al. | 28/17 |
| 4,091,512 | 5/1978 | Chambley et al. | 226/97 X |
| 4,164,331 | 8/1979 | Henrich | 242/157 R X |
| 4,634,070 | 1/1987 | Looper | 242/413.5 X |
| 4,790,468 | 12/1988 | Nakashima et al. | 226/196 X |
| 5,242,095 | 9/1993 | Creapo et al. | 226/97 |
| 5,423,468 | 6/1995 | Liedtke | 226/196 X |

*Primary Examiner*—Michael Mansen
*Attorney, Agent, or Firm*—Shefte, Pinckney & Sawyer

[57] ABSTRACT

A support for a traveling strand of rubber yarn being wound on a winder is disposed intermediate a rubber yarn supply in the winder with the support including a vertically oriented support member disposed upstream of the winder and downstream of the yarn supply and a first frictionless bearing movably mounted to the support for selected vertical movement of the bearing to allow entanglements of rubber to dissipate as the yarn travels the vertical distances between the supply and the first frictionless bearing and the first frictionless bearing and the winder.

14 Claims, 3 Drawing Sheets

SUPPORT FOR A TRAVELING STRAND OF RUBBER YARN

BACKGROUND OF THE INVENTION

The present invention relates broadly to auxiliary support apparatus for traveling yarn associated with a yarn package winder and, more particularly, to a support for a traveling strand of rubber yarn in order to support the strand being removed from a supply.

One way of packaging and shipping natural rubber yarn is to form the yarn into a tape consisting of several individual yarn strands fused together in a parallel, side-by-side relationship. The resulting tape is flexible, generally flat and elongate. The tape is laid into a supply box in a semi-random manner for shipment. After shipping, and before winding, the tape must be separated into individual yarn strands and, prior to that, be withdrawn from the box. Accordingly, there is a tendency for some of the tape to tangle due to its shape, weight and flexibility. The natural rubber yarn is somewhat heavier than conventional yarn and the fused tape is relatively heavy. Knots or tangles can form in the tape as it is being withdrawn from the box and such knots and tangles can disrupt winding operations.

Accordingly, there is a need to address and rectify knots or tangles prior to entry of the tape into the winder.

SUMMARY OF THE INVENTION

It is accordingly an object of the present invention to address the problems of knots and tangles occurring in rubber yarn tape as it is being removed from a shipping box prior to winding.

It is another object of the present invention to provide an apparatus for straightening the yarn as it is being withdrawn from the box.

It is another object of the present invention to control the winder based on the occurrence of knots and tangles in rubber yarn tape as it is being withdrawn from the box.

To that end, a support for a traveling strand of rubber yarn being wound on a winder is disposed intermediate the rubber yarn supply and the winder with the support including a vertically oriented support member disposed upstream of the winder and downstream of the yarn supply. A first frictionless bearing is movably mounted to the support for selected vertical movement of the bearing so that when the bearing is secured in a raised position entanglements of rubber yarn dissipate as the yarn travels the vertical distances between the supply and first frictionless bearing and between the first frictionless bearing and the winder. Preferably, the present invention further includes a second frictionless bearing disposed at a predetermined vertical spacing downstream of the first frictionless bearing intermediate the first frictionless bearing and the winder with the second frictionless bearing being disposed for supporting the traveling strand of rubber yarn moving vertically to the first frictionless bearing and across the second frictionless bearing to the winder.

Preferably, the winder includes an apparatus for imparting motion to the traveling strand to move the strand through a predetermined travel path and the support of the present invention preferably further includes a device for switching off the motion imparting apparatus with the switching means being mounted to the first frictionless bearing. Preferably, the switching arrangement includes a switch in electrical communication with motion imparting apparatus and an assembly for actuating the switch, with the actuating assembly being disposed closely adjacent the travel path for actuation upon impact from a yarn entanglement. It is preferred that the actuating arrangement include an arm pivotally mounted to the first frictionless bearing in operational communication with the switch for pivotal movement of the arm, and subsequent actuation of the switch upon impact from a yarn entanglement.

It is preferred that the first frictionless bearing be formed with a curved surface having a plurality of perforations formed therein for yarn movement thereacross and includes an assembly for forcing air through the perforations to provide an air cushion for yarn support as the yarn travels across the first frictionless bearing. It is further preferred that the second frictionless bearing be formed with a similar curved surface having a plurality of perforations formed therein for yarn movement thereacross and includes an assembly for forcing air through the perforations to provide an air cushion for yarn support as the yarn travels across the second frictionless bearing.

The present invention further includes an assembly for controlling movement of the first frictionless bearing for disposition of the first frictionless bearing at a predetermined vertical position relative to the winder.

Preferably, the vertically oriented support member includes a vertically extending channel and the first frictionless bearing includes an assembly for slidably engaging the channel for vertical sliding movement of the first frictionless bearing control by the arrangement for controlling movement of the first frictionless bearing. It is preferred that the control arrangement include a line attached to the first frictionless bearing and a cleat attached to the vertically oriented support member configured for sliding movement of the first frictionless bearing responsive to manipulation of the line and for securing the first frictionless bearing against movement by attaching the line to the cleat.

By the above, the present invention provides a unique support for traveling rubber yarn which allows the rubber yarn to transit a substantial vertical distance while being withdrawn from the supply so that the natural weight of the rubber yarn will tend to untangle any knots or entanglements prior to entry into the winder.

DETAILED DESCRIPTION OF THE PREFERRED EMBODIMENT

Figure 1:
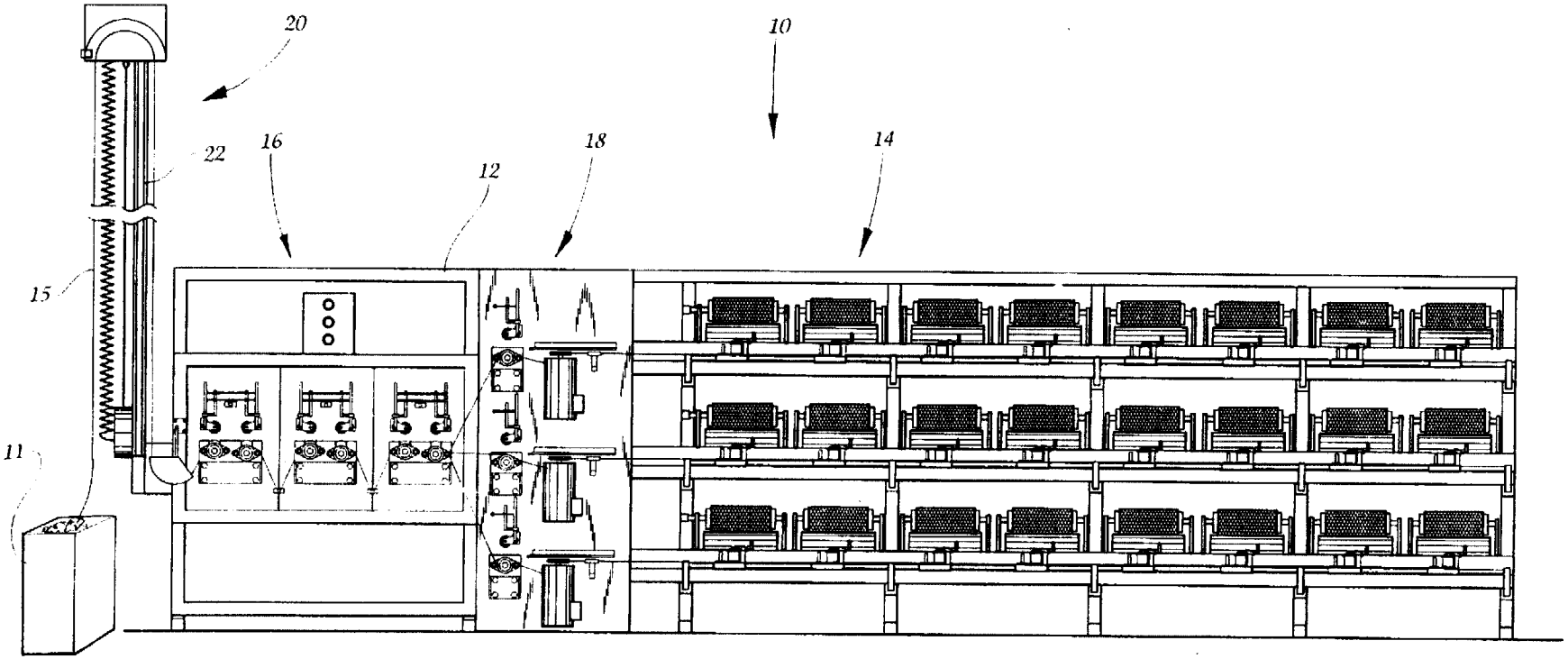
FIG. 1 is an elevational view of a rubber yarn winder including a yarn support apparatus according to the preferred embodiment of the present invention.

Turning now to the drawings and, more particularly, to FIG. 1, a winder for rubber yarn is illustrated generally at 10 and includes several operationally described sections mounted to a skeletal frame 12, formed of stock steel. At one end thereof, a bank of traverse mechanisms 14 provides surface winding of the yarn into packages. Upstream, a tractor assembly 18 is provided as well as a yarn stretching assembly 16 upstream of the tractor assembly 18. The subject of the present invention is upstream of the stretching assembly 16 and is disposed intermediate a yarn supply 11 and the stretching assembly 16. There, a vertically oriented support 20 is provided and mounted to the end of the frame 12 opposite the traverse mechanisms 14.

Figure 2:
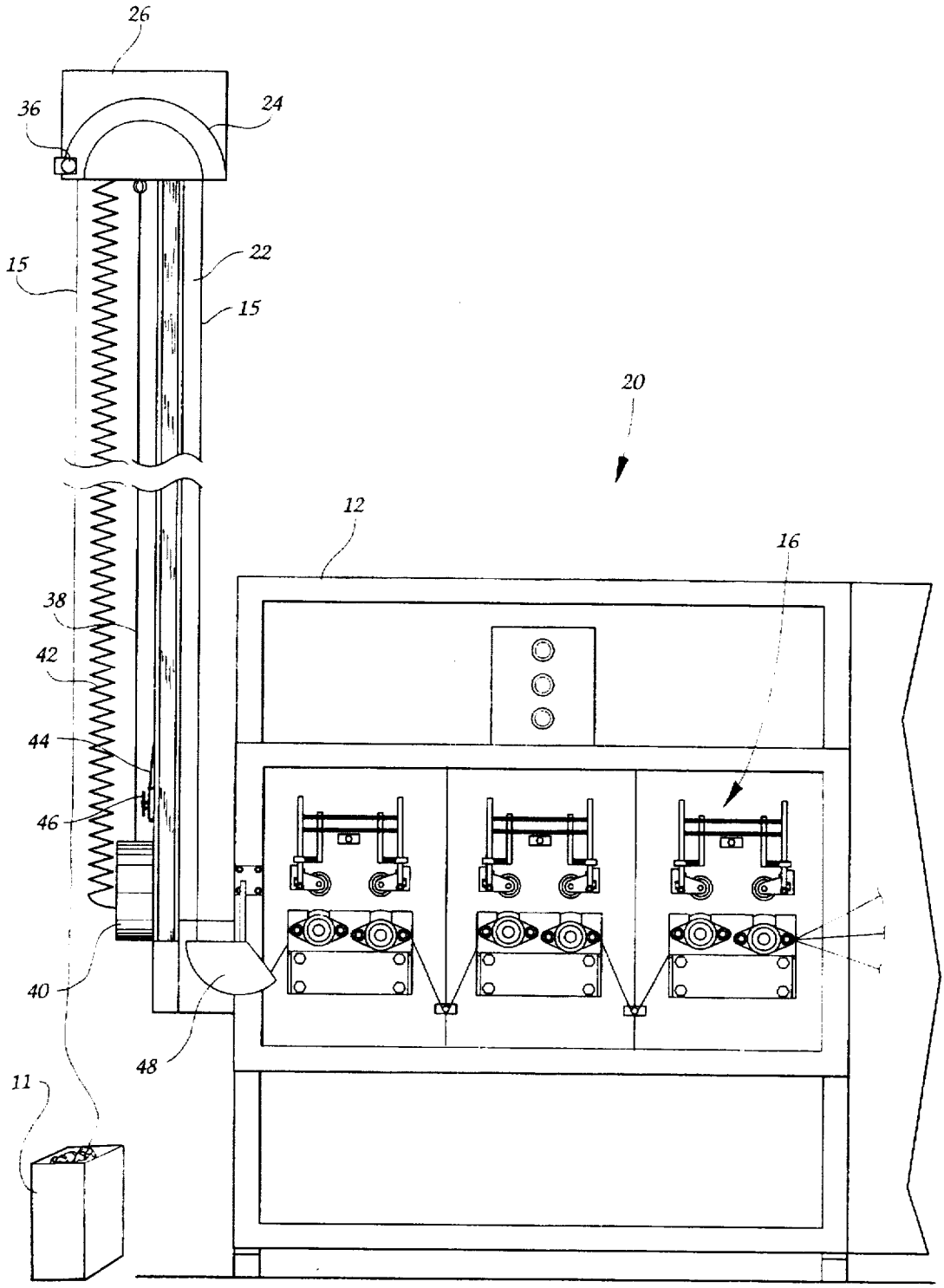
FIG. 2 is an elevational view of one end of the winder illustrating the mounting of the support according to the present invention.

Turning now to FIG. 2, the support according to the preferred embodiment of the present invention is illustrated in greater detail at 20. The yarn support 20 includes a vertically oriented support member 22 which is formed from channel stock and mounted to the frame 12. The vertical support member 22 is shown broken apart in FIGS. 1 and 2 for clarity but it should be understood that the approximate height of the channel is twelve feet. A first, frictionless, pneumatic bearing 24 is mounted to the uppermost extent of the vertical support member 22 in a slidable fashion. Typically, rollers (not shown) will be provided on the first bearing 24 for rolling movement within the channel 22. A conventional line 44 is attached to the first bearing 24 and through a pulley system (not shown) the first bearing 24 may be raised and lowered in the manner of a flag. A cleat 46 is provided on the side or rear of the vertical support member 22 to tie off the line 44 when the first bearing 24 is in its uppermost position. As will be explained in greater detail hereinafter, the first bearing 24 requires an electrical line connection 38 and a pneumatic line connection 42. The pneumatic line 42 is coiled while the electrical line 38 is taken up in a reel 40 at the base of the support 20. A second air bearing 48 which is constructed similarly to the first bearing 24 is disposed below the first bearing 24. The primary distinction between the two air bearings is the shape and extent of the track. The first bearing 24 extends through 180° while the second bearing 48 extends through approximately 1200.

Figure 3:
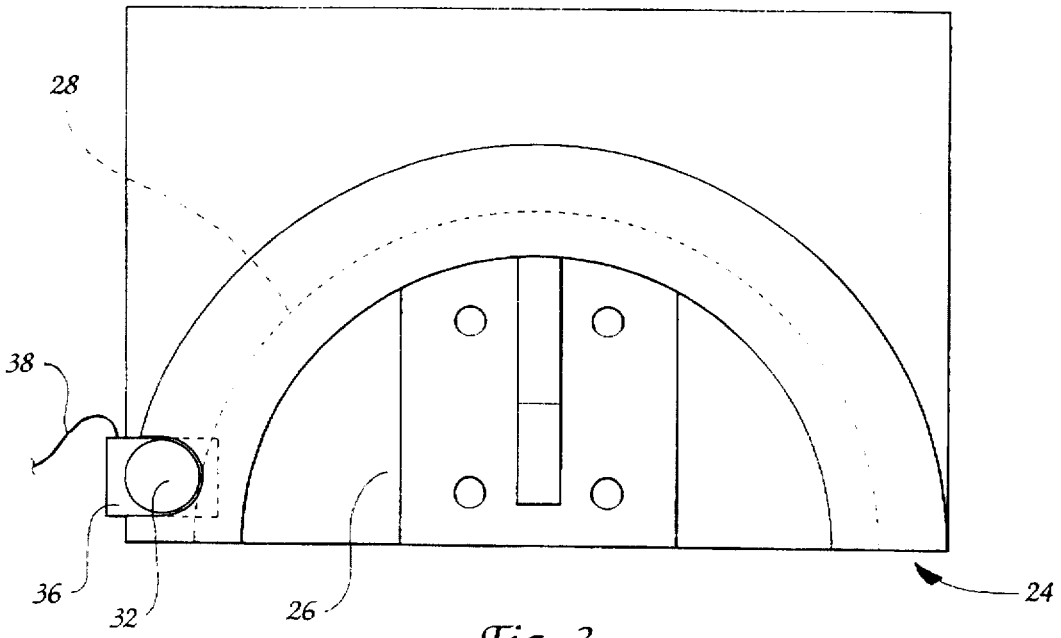
FIG. 3 is a side view of the first frictionless bearing.
Figure 4:
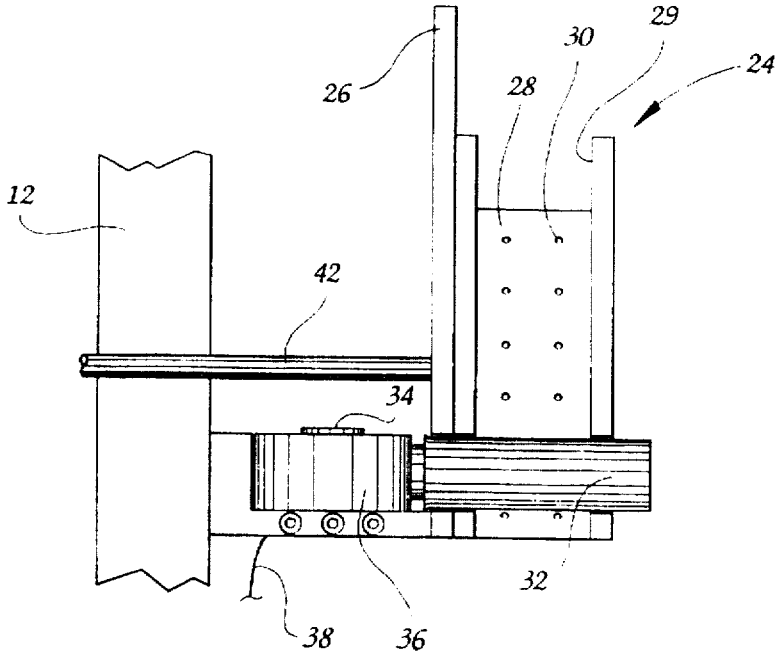
FIG. 4 is an end view of the first frictionless bearing.

With reference to FIGS. 3 and 4, the first bearing 24 is illustrated in greater detail. The first bearing 24 includes a curved surface 28 which extends through 180° and is mounted to a bracket 26. An electrical switch 36 is pivotally mounted to the frame 12 as best seen in FIG. 4. The electrical line 38 is connected to the switch 36. The switch 36 is mounted for movement about a pivot 34 and is driven pivotally thereabout by impact on an arm 32 which extends into the travel path of the traveling strand 15. The curved surface 28 includes a plurality of openings 30 through which air is forced from the pneumatic line 24. The forced air provides a cushion for frictionless movement of the tape across the bearing 24. Any knots or entanglements which did not drop out during the upward transit to the first bearing 24 collide with the switching arm 32 to cause pivotal movement of the switch 36, a signal from which is used to enact a cutoff of the winder 10.

In operation, the line 44 is loosened from the cleat 46 and the first bearing 24 is allowed to ride down the channel to a convenient location for thread-up. The yarn 15 is draped over the perforated surface 28 and then wound onto the winder 10. The bracket 26, along with the first bearing 24, is raised using the line 44 to its maximum height, thereby extending the electrical cord 38 from the reel 40 and expanding the coiled pneumatic line 42. The line 44 is then tied off on the cleat 46. Once winding operations are commenced, the yarn travels upwardly to the first bearing 24 and transits the bearing surface on a cushion of air. The yarn then travels downwardly to the second bearing 48 for distribution to the stretcher assembly 16 and on out into the winder 10. Since the air bearings 24,48 impart no friction to the traveling strand, no drag is imposed on the line and, normally, many yarn entanglements occurring from the box 11 fall out on the vertical transit to the first bearing 24. Those that make it to the top collide with the switching arm 32, thereby causing interruption of power to the winder 10 and stopping winding operations. Further, this stoppage acts to alert the operator who can then intercept the yarn entanglement on the downward portion of its journey up and over the first air bearing 24.

By the above, the present invention provides an apparatus which can rapidly speed the winding process by allowing many yarn entanglements to drop out prior to causing disruptions with the winding machine.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A support for a traveling strand of rubber yam being wound on a winder, said winder including an apparatus for imparting motion to the traveling strand to move the strand through a predetermined travel path, said support being disposed intermediate a rubber yarn supply and the winder, said support comprising:

a first pneumatic bearing for guiding the rubber yarn, a vertically extending support member, and a means for movably mounting said first pneumatic bearing to said support member for selected vertical movement to a selected vertical position to thereby allow entanglements of the rubber yarn to dissipate as the yarn travels the vertical distances between the yarn supply and said first pneumatic bearing, and between said first pneumatic bearing and the winder.

2. A support for a traveling strand of rubber yarn according to claim 1 and further comprising a second pneumatic bearing disposed at a predetermined vertical spacing downstream of said first pneumatic bearing intermediate said first pneumatic bearing and the winder, said second pneumatic bearing being disposed for supporting the traveling strand of rubber yarn moving vertically to said first pneumatic bearing and across said second pneumatic bearing to the winder.

3. A support for a traveling strand of rubber yarn according to claim 1 and further comprising means for switching off the apparatus for imparting motion to the traveling strand, said switching means being mounted to said first pneumatic bearing.

4. A support for a traveling strand of rubber yarn according to claim 3 wherein said switching means includes a switch in electrical communication with the apparatus for imparting motion to the traveling strand and means for actuating said switch, said actuating means being disposed closely adjacent said travel path for actuation upon impact from a yarn entanglement.

5. A support for a traveling strand of rubber yarn according to claim 4 wherein said actuating means includes an arm pivotally mounted to said first pneumatic bearing and in operational communication with said switch for pivotal movement of said arm, and subsequent actuation of said switch upon impact from a yarn entanglement.

6. A support for a traveling strand of rubber yarn according to claim 1 wherein said first pneumatic bearing is formed with a curved surface having a plurality of perforations formed therein for yarn movement thereacross, and includes means for forcing air through said perforations to provide an air cushion for yarn support as the yarn travels across said first pneumatic bearing.

7. A support for a traveling strand of rubber yarn according to claim 2 wherein said second pneumatic bearing is formed with a curved surface having a plurality of perforations formed therein for yarn movement thereacross, and include means for forcing air through said perforations to provide an air cushion for yarn support as the yarn travels across said second pneumatic bearing.

8. A support for a traveling strand of rubber yarn according to claim 1 wherein said support includes means for controlling movement of said first pneumatic bearing for disposition of said first pneumatic bearing at a predetermined vertical position relative to said winder.

9. A support for a traveling strand of rubber yarn according to claim 8 wherein said vertically oriented support member includes a vertically extending channel and said first pneumatic bearing includes means for slidably engaging said channel for vertical sliding movement of said first pneumatic bearing controlled by said means for controlling movement of said first pneumatic bearing.

10. A support for a traveling strand of rubber yarn according to claim 9 wherein said control means includes a line attached to said first pneumatic bearing and a cleat attached to said vertically oriented support member configured for sliding movement of said first pneumatic bearing responsive to manipulation of said line and for securing said first pneumatic bearing against movement by attaching said line to said cleat.

11. A support for a traveling strand of rubber yarn being wound on a winder, said winder including an apparatus for imparting motion to the yarn to move the yarn through a predetermined travel path, said support being disposed intermediate rubber yarn supply and said winder, said support comprising:

a vertically oriented support member formed with a channel therein and disposed upstream of the winder and downstream of the yarn supply, a first pneumatic bearing slidably mounted to said channel for selected vertical movement of said first pneumatic bearing along said vertically oriented support member, said first pneumatic bearing being formed with a curved surface formed with a plurality of perforations therein for yarn movement thereacross, and include means for forcing air through said perforations to provide an air cushion for yarn support as the yarn travels across said first pneumatic bearing;

means for switching off the motion imparting apparatus, said switching means being mounted to said first pneumatic bearing, said switching means including a switch in electrical communication with the motion imparting apparatus and means for actuating said switch, said actuating means being disposed closely adjacent said travel path for actuation upon impact from a yarn entanglement;

a second pneumatic bearing formed with a curved surface, said surface being formed with a plurality of perforations therein for yarn movement thereacross, and including means for forcing air through said perforations to provide an air cushion for yarn support as the yarn travels across said second pneumatic bearing, said second pneumatic bearing being disposed at a predetermined vertical spacing downstream of said first pneumatic bearing thereby supporting a traveling strand of rubber yarn moving vertically to said first pneumatic bearing and across said second pneumatic bearing to allow entanglements of rubber yarn to dissipate as the yarn travels the vertical distances between the supply and said first pneumatic bearing and said second pneumatic bearing.

12. A support for a traveling strand of rubber yarn according to claim 11 wherein said actuating means includes an arm pivotally mounted to said first pneumatic bearing and in operational communication with said switch for pivotal movement of said arm, and subsequent actuation of said switch upon impact from a yarn entanglement.

13. A support for a traveling strand of rubber yarn according to claim 11 wherein said support includes means for controlling movement of said first pneumatic bearing for disposition of said first pneumatic bearing at a predetermined vertical position relative to said second pneumatic bearing.

14. A support for a traveling strand of rubber yarn according to claim 13 wherein said control means includes a line attached to said first pneumatic bearing and a cleat attached to said vertically oriented support member configured for sliding movement of said first pneumatic bearing responsive to manipulation of said line and for securing said first pneumatic bearing against movement by attaching said line to said cleat.

* * * * *